US011021911B2

(12) United States Patent
Liu et al.

(10) Patent No.: US 11,021,911 B2
(45) Date of Patent: Jun. 1, 2021

(54) ROTARY GUIDING DEVICE BASED ON RADIAL DRIVING FORCE

(71) Applicant: Institute of Geology and Geophysics, Chinese Academy of Sciences, Beijing (CN)

(72) Inventors: Qingbo Liu, Beijing (CN); Qingyun Di, Beijing (CN); Tsili Wang, Beijing (CN); Wenxuan Chen, Beijing (CN); Jiansheng Du, Beijing (CN); Yongyou Yang, Beijing (CN); Xinzhen He, Beijing (CN); Linfeng Hong, Beijing (CN); Qijun Xie, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 85 days.

(21) Appl. No.: 16/466,238

(22) PCT Filed: Mar. 2, 2018

(86) PCT No.: PCT/CN2018/000085
§ 371 (c)(1),
(2) Date: Jun. 3, 2019

(87) PCT Pub. No.: WO2019/095526
PCT Pub. Date: May 23, 2019

(65) Prior Publication Data

US 2020/0087986 A1 Mar. 19, 2020

(30) Foreign Application Priority Data

Nov. 14, 2017 (CN) ..... 201711119970.3

(51) Int. Cl.
*E21B 7/06* (2006.01)

(52) U.S. Cl.
CPC ..... *E21B 7/061* (2013.01)

(58) Field of Classification Search
CPC . E21B 7/061; E21B 7/062; E21B 7/06; E21B 7/04
See application file for complete search history.

(56) References Cited

U.S. PATENT DOCUMENTS 6,109,372 A 8/2000 Dorel et al.
6,533,040 B2 * 3/2003 Gondouin ..... E21B 7/065 166/380

(Continued)

FOREIGN PATENT DOCUMENTS

CN 1266940 A 9/2000
CN 101772614 A 7/2010

(Continued)

OTHER PUBLICATIONS

International Search Report for PCT/CN2018/000085 (PCT/ISA/210) dated Aug. 10, 2018, with the English translation. 1.

*Primary Examiner* — Caroline N Butcher
(74) *Attorney, Agent, or Firm* — Staas & Halsey LLP

(57) ABSTRACT

A rotary guiding device includes a rotating shaft to rotationally drive a tool head. The rotating shaft includes upper and lower shaft portions, and a steerable portion, the upper shaft portion and the lower shaft portion are steerably connected by the steerable portion. A non-rotating body is mounted on the upper shaft portion, the non-rotating body is substantially non-rotating with respect to the rotating shaft in circumferential direction when the rotating shaft rotationally drives the tool head. The lower shaft portion includes a rib portion coinciding at least partially in axial direction with the non-rotating body. The non-rotating body includes at least three hydraulic driving mechanisms uniformly distributed along its circumferential direction, the three hydraulic driving mechanisms controllably generate radial drive (Continued)

forces respectively, the radial driving forces act on the rib portion overlapping the non-rotating body so the lower shaft portion can be deflectable relative to the steerable portion.

8 Claims, 3 Drawing Sheets

(56) References Cited

U.S. PATENT DOCUMENTS

| | | | | |
|---|---|---|---|---|
| 2009/0166089 | A1 | 7/2009 | Millet | |
| 2012/0018225 | A1 | 1/2012 | Peter et al. | |
| 2012/0080233 | A1* | 4/2012 | Hall | E21B 7/062 175/61 |
| 2012/0145458 | A1 | 6/2012 | Downton | |
| 2014/0209389 | A1 | 7/2014 | Sugiura et al. | |
| 2015/0308193 | A1 | 10/2015 | Schurmann | |
| 2015/0330149 | A1 | 11/2015 | Winslow et al. | |
| 2017/0234072 | A1 | 8/2017 | Sonar et al. | |
| 2018/0016845 | A1* | 1/2018 | Peters | E21B 7/067 |

FOREIGN PATENT DOCUMENTS

| | | | |
|---|---|---|---|
| CN | 102606073 | A | 7/2012 |
| CN | 203383731 | U | 1/2014 |
| CN | 105051316 | A | 11/2015 |
| CN | 104838083 | B | 6/2017 |
| CN | 107060643 | A | 8/2017 |
| CN | 104812987 | B | 9/2018 |
| WO | WO 2016/060683 | A1 | 4/2016 |

* cited by examiner

ROTARY GUIDING DEVICE BASED ON RADIAL DRIVING FORCE

TECHNICAL FIELD

The invention relates to the field of drilling, and more particularly to a rotary guiding device based on radial driving force.

BACKGROUND TECHNOLOGY

In order to obtain natural resources storaged underground, drilling exploration is required. In many cases, the wellbore and the derrick are not aligned, but need to form a certain offset or bend. This process of forming horizontal or vertical offsets or other types of complex holes is called directional drilling. In the process of directional drilling, the direction control of the drill bit is called guidance. Modern directional drilling has two types: sliding guidance and rotary guidance. The drill string does not rotate when sliding guiding drilling; the bottom hole power drill (turbine drill, screw drill) drives the drill bit to rotate. The screw drilling tool and part of the drill string and the centralizer can only slide up and down against the well wall. Its shortcomings are large friction, effective weight-on-bit, low torque and power, low drilling rate, the wellbore spiralled and unsmooth and unclean, poor quality, easy to accident, and often forced to start the drill disc with "composite drilling", and "composite drilling" is often limited to use. The limit depth of sliding guidance is less than 4000 m. In order to change the orientation of the hole, it is necessary to change the structure of the drill string. Rotary steerable drilling system is the rotary drive of the drill string, the drill string and the rotary guiding tool are rolled on the well wall, and the rolling friction resistance is small. The rotary steerable drilling system can control and adjust its slanting and orienting function during drilling, and can complete the slanting, increasing the slope, stabilizing the slope and descending the slope along with the drilling process, and the friction is small, the torque is small, the drilling speed is high, larger drill bit penetration, the aging is high, the cost is low, and the well shaft is easy to control. With a limit of 15 km, it is a new type of weapon for drilling complex structural wells and offshore oil systems and super-large displacement wells (10 km).

There are also two commonly used rotary guiding technologies, one is a directional guidance and the other is a push-oriented guidance. The Chinese authorized patent CN104619944B obtained by the American company Halliburton discloses a directional guiding tool, which provides modular actuators, guiding tools and rotary steerable drilling systems, the modular actuator includes a barrel portion, and the modular actuator is configured to be coupled to an outer circumference of the outer casing. The accumulator is housed in the barrel portion, and a hydraulically actuated actuator is slidably disposed within the barrel portion, the actuator is moveable between an activated position and an inactive position such that the actuator piston selectively squeezes the ramped surface of the drive shaft to change the direction of the drill string. The U.S. patent application US20140209389A1 discloses a rotary guiding tool, which comprises a non-rotating sleeve, a rotating shaft comprising a deflectable unit, the deflection unit being deflected by controlling the circumferential position of the eccentric bushing, thereby adjusting the drilling direction of the drill bit. Another type of rotary steering technique, namely push-oriented rotary guidance technology, is disclosed in US Patent Application No. US20170107762A1, it includes a pushing member disposed around the drill pipe and a hydraulic drive system for driving the pushing member, and the hydraulic drive system selectively drives the pushing member to move between the abutment position and the non-push position, in the abutment position, the pushing member can push against the the wall of the well in a slapping way to generate guiding force and change the direction of the drilling hole.

Both the directional guidance and the push-oriented guidance have their own characteristics. Generally speaking, the slope of the directional guidance is relatively stable, which is less affected by the drilling pressure and formation conditions, but the limit value of the slope is low, and it is difficult to meet the requirements when a high build-up slope is required. Relatively speaking, the slope of the push-oriented guidance is not stable, and it is greatly affected by the drilling pressure and formation conditions, when the drilling pressure is low and the hardness of the formation is appropriate, the slope is large, and the well trajectory can be quickly adjusted, however, the guiding ability is reduced when the soft formation is encountered.

Recently, some people have proposed hybrid guidance tools, however, the driving method for providing driving force has not been well realized. In addition, the difficulty of measurement and control and the energy consumption problem in the underground are also very important. On the one hand, when the downhole component rotates with the drill pipe, it will cause difficulty in measuring the corresponding component, which is a problem that cannot be ignored, and how to make data measurement simple is an important issue; On the other hand, underground energy is mainly from mud power generation, in addition to ensuring the operation of the electronic components downhole, it is also necessary to provide the energy required to guide the drive, and it is also important to provide a guided drive with as low power as possible.

Therefore, the prior art requires a high-slope-while-drilling rotary guided drive technology that is compact in structure and can reduce control difficulty.

SUMMARY OF THE INVENTION

In order to solve the above problems, the invention proposes a rotary guiding device based on radial driving force, comprising: a rotating shaft, the rotating shaft is used to drive a tool head to rotate, the rotating shaft includes an upper shaft portion, a lower shaft portion, and a steerable portion, the upper shaft portion and the lower shaft portion are steerably connected by the steerable portion;

a non-rotating body mounted on the upper shaft portion, the non-rotating body is substantially non-rotating with respect to the rotating shaft in is the circumferential direction when the rotating shaft rotationally drives the tool head, the lower shaft portion includes a rib portion that coincides at least partially in the axial direction with the non-rotating body, the non-rotating body includes at least three hydraulic driving mechanisms uniformly distributed along its circumferential direction, the three hydraulic driving mechanisms are adapted to controllably generate radial drive forces respectively, the radial driving forces acts on the rib portion that is overlapped with the non-rotating body so that the lower shaft portion can be deflectable relative to the steerable portion.

Preferably, the steerable portion includes a cardan shaft or a flexible shaft.

Preferably, a centralizer is disposed on the lower shaft portion, the centralizer is arranged such that when the hydraulic driving mechanism drives the rib portion to deflect, the centralizer is adapted to push against the well wall so that the lower shaft portion deflects relative to the steerable portion.

Preferably, the hydraulic driving mechanism and the centralizer are respectively disposed on two sides of the steerable portion.

Preferably, the rotary guiding device also includes a universal bearing which is disposed between the non-rotating body and the upper shaft portion, the universal bearing is disposed at a position that substantially coincides with the set position of the hydraulic driving mechanism in the axial direction, the steerable portion is disposed on one side of the hydraulic driving mechanism and the centralizer, and the side is away from the tool head.

Preferably, the centralizer is detachably coupled to the lower shaft portion.

Preferably, the rotary guiding device also includes a universal bearing which is disposed between the non-rotating body and the upper shaft portion.

Preferably, the hydraulic driving mechanism includes a hydraulic cylinder disposed along a radial direction of the non-rotating body and a piston disposed in the hydraulic cylinder, a push ball is disposed between the piston and the rib portion, the piston pushes against the rib portion by the push ball.

Preferably, the non-rotating body is provided with a circuit cavity, and the circuit cavity is connected to the hydraulic driving mechanism.

The rotary guiding device proposed by the present invention, the rib portion can be pushed by means of a hydraulic driving mechanism which is capable of providing a radial driving force, in this way a guiding force can be generated to the tool head by using the lever principle. At the same time, the guiding device of the present invention can provide a larger range of selectable build-up rate to meet different formation requirements, meanwhile, for the pushing part in the hybrid guiding device, it doesn't drive the entire drill tool assembly any more, and it only needs to drive the lower shaft portion to rotate around the steerable portion, which greatly saves the energy consumption for the guiding under the well.

BRIEF DESCRIPTION OF THE DRAWINGS

The drawings described herein are intended to provide a further understanding of the invention, and are intended to be a part of this invention. The schematic embodiments of this invention and their descriptions are used to interpret this invention and do not constitute an undue limitation of this invention. In the drawing.

DETAILED DESCRIPTION:

In order to explain the overall concept of the present invention more clearly, the following detailed description is illustrated by way of example with reference to the attached drawings. It should be noted that, in this context, relational terms such as "first" and "second" are used to distinguish one entity or operation from another entity or operation, and it is not necessary to require or imply that there is such an actual relationship or order between these entities or operations.

Furthermore, the terms "including" "comprising" or any other similar description is intended to cover a non-exclusive contain, which leads to a series of processes, methods, objects, or equipment not only include the elements listed in the context, but also include other elements which is not listed in the context, or the inherent elements of the processes, methods, objects, or equipment. In the absence of further restrictions, elements defined by the statement "including one" are not excluded from the inclusion, but include other identical elements.

The rotary guiding device disclosed herein relates to application scenarios for oilfield drilling or other exploration drilling. Other system components associated with rotary guiding device, such as derrick systems, powertrains, and signaling systems, are not described extensively here.

Embodiment 1

Figure 1:
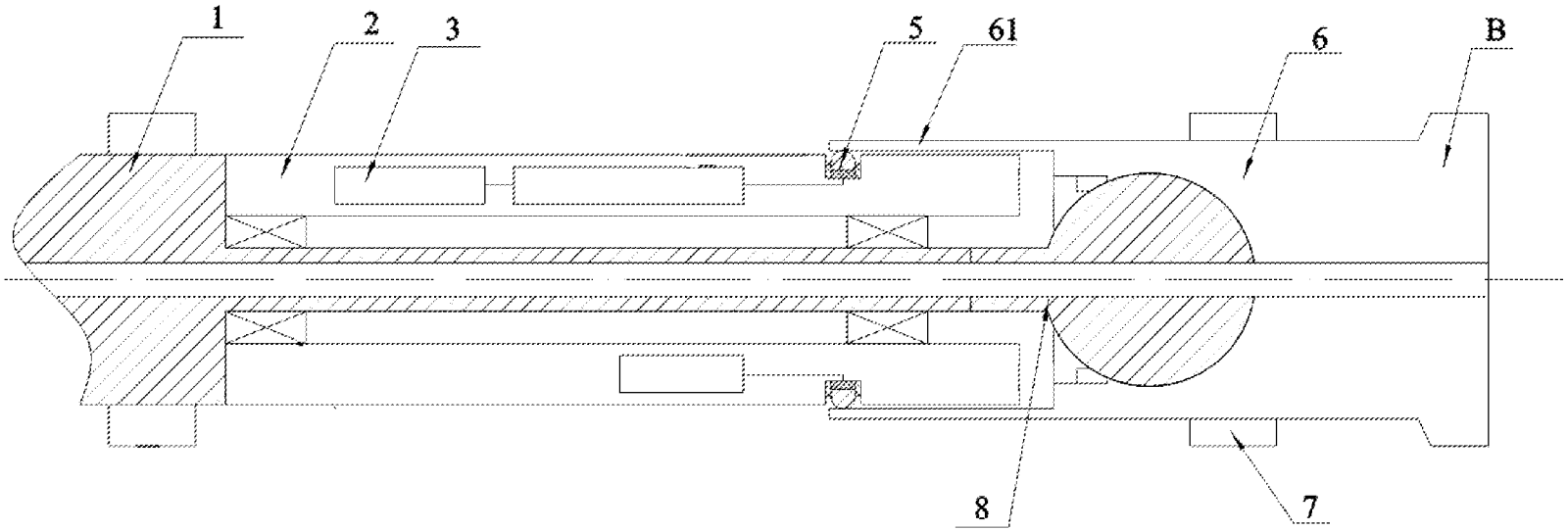
FIG. 1 is a rotary guiding device according to the first embodiment of the invention.

As shown in FIG. 1, the embodiment proposes a rotary guiding device based on radial driving force. In this embodiment, the rotary guiding device belongs to a hybrid rotary guiding device. Specifically, the hybrid rotary guiding device includes:a rotating shaft, the rotating shaft includes an upper shaft portion 1, a lower shaft portion 6, and a steerable portion 8. The rotating shaft is used to drive the the tool head B to rotate. A separation distance exists between the upper shaft portion 1 and the lower shaft portion 6 in the axial direction, and the separation distance can provide a space for the rotation of the lower shaft portion 6 relative to the upper shaft portion 1. The upper shaft portion 1 and the lower shaft portion 6 are steerably connected by the steerable portion 8. Thereby, under the driving force, the lower shaft portion 6 connected to the tool head B can provide guidance in a partially movable manner without the need to drive the entire drill tool assembly.

The rotary guiding device includes a non-rotating body 2 mounted on the upper shaft portion 1, the non-rotating body 2 is substantially non-rotating with respect to the rotating shaft in the circumferential direction when the rotating shaft rotationally drives the tool head. In the actual working environment, the non-rotating body 2 is rotated at a lower speed due to the action of friction and inertia. The lower shaft portion 6 includes a rib portion 61 that coincides at least partially in the axial direction with the non-rotating body 2, as shown in FIG. 1 the non-rotating body 2 includes at least three hydraulic driving mechanisms 5 uniformly distributed along its circumferential direction. In general, the hydraulic driving mechanism 5 may be three or four. The three hydraulic driving mechanisms 5 are adapted to controllably generate radial drive forces respectively, the radial driving forces acts on the rib portion that is overlapped with the non-rotating body so that the lower shaft portion can be deflectable relative to the steerable portion. What's different from the prior art is that the hydraulic driving mechanism 5 is used to actively apply a driving force to the rib portion to generate a controllable lever force in the embodiment, and there is no redundant degree of freedom between the active and the passive part in the process of driving. At the same time, the lever-type drive structure formed by the radially arranged hydraulic cylinders in an axially overlapping manner becomes a compact drive structure formed in the drill tool assembly. The hydraulic driving mechanism includes a hydraulic cylinder disposed along a radial direction of the non-rotating body and a piston disposed in the hydraulic cylinder.

In the embodiment shown in FIG. 1, the steerable portion is a universal joint mechanism 8. It will be understood by those skilled in the art that similar structures which are capable of providing a guiding function can be substituted for the above-described universal joint mechanism, such as a flexible shaft.

Preferably, a lower centralizer 7 is disposed on the lower shaft portion 6, the lower centralizer 7 is arranged such that when the hydraulic driving mechanism drives the rib portion to deflect, the lower centralizer 7 is adapted to push against the well wall so that the lower shaft portion 6 deflects relative to the steerable portion. The outer surface of the lower centralizer 7 is coated with a wear-resistant material, such as a cemented carbide material or a polydiamond composite material. On the one hand, in the present embodiment, the lower centralizer 7 can protect other parts of the drill from contacting the well wall during the drilling process, thereby avoiding wear of the drill. On the other hand, what is very important for the rotation guidance of this embodiment is that, when the hydraulic driving mechanism applies a radial force to the rib 61, firstly, the lower shaft portion 6 is rotated with the center of the universal joint mechanism 8 as a fulcrum, and after moving to a certain extent, the centralizer 7 is drived to deflect outwardly, and the centralizer 7 is caused to push against the well wall, and the fulcrum becomes the contact point between the lower centralizer 7 and the well wall. As shown in FIG. 1, the hydraulic driving mechanism 5 and the lower centralizer 7 are respectively disposed on both sides of the universal joint mechanism 8, so that the direction of the torque generated by the radial driving force acting on the lower shaft portion 6 is the same with the direction of the torque generated by the lower centralizer 7 acting on the well wall. That is to say, the lower centralizer 7 acts as a limit structure for the directional guiding action, and at the same time, it improves the stress state of the universal joint mechanism and increases its service life.

In an embodiment that is not shown in detail in the figures, the lower centralizer 7 is detachably mounted on the lower shaft portion 6, and the outer diameter of the lower centralizer 7 mounted on the lower shaft portion 6 is optional. The magnitude of the pointing angle of the rotary guide (i.e., the angle at which the tool head is deflected from the upper shaft portion) is largely determined by the outer diameter of the lower centralizer 7 during the rotational guidance. The larger the diameter of the lower centralizer 7, the larger the pointing angle that can be produced, and the smaller the diameter of the lower centralizer 7, the smaller the pointing angle that can be generated, so that the lower centralizer 7 with different diameters can be selected according to the needs of different build-up rate.

Embodiment 2

Figure 2:
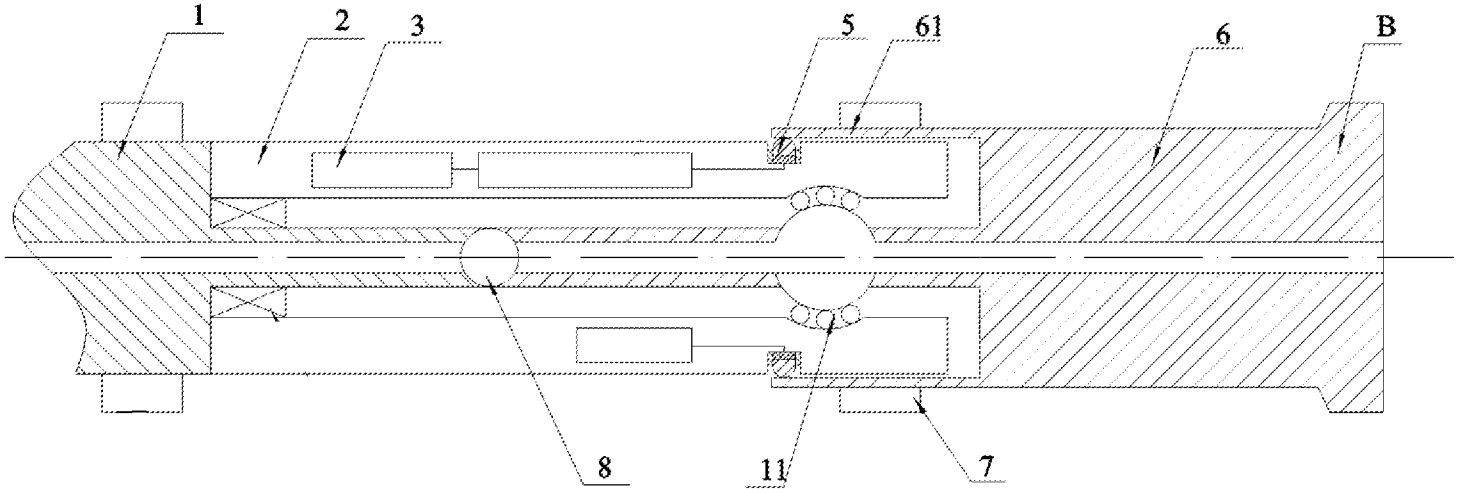
FIG. 2 is a rotary guiding device according to the second embodiment of the invention.

The rotary guiding device in this embodiment is generally similar to the guiding device in Embodiment 1, the main difference is that the rotary guiding device in this embodiment further includes a universal bearing 11 disposed between the non-rotating body and the upper shaft portion, the universal bearing 11 is disposed at a position that substantially coincides with the set position of the hydraulic driving mechanism in the axial direction, the steerable portion 8 is disposed on one side of the hydraulic driving mechanism and the centralizer, and the side is away from the tool head. Specifically, the position of the steerable portion 8 is located on the left side of the hydraulic driving mechanism 5 and the lower centralizer 7, at the same time, one side of the support structure of the non-rotating body 2 is provided with a universal bearing 11, and the side is close to the hydraulic driving mechanism 5. The universal bearing 11 is capable of withstanding and transmitting radial forces and axial forces. When the hydraulic driving mechanism 5 generates a radial force, the directional and push-by functions can be respectively generated on the lower shaft portion 6. For example, when the upper hydraulic driving mechanism 5 in FIG. 2 provides an outward driving force, during the process in which the piston of the hydraulic cylinder gradually protrudes outward, firstly, the hydraulic driving mechanism 5 can transmit a downward biasing force to the core of the lower shaft portion 6 via the non-rotating body 2 and the universal bearing 11, which acts on the core of the lower shaft portion 6, so that the lower shaft portion 6 can be deflected downward around the universal joint mechanism 8 to form a directional guide. As the lower shaft portion 6 is deflected, the lower centralizer 7 above the lower shaft portion gradually contacts and pushes against the well wall, generating a downward reaction force, thereby further generating a torque that causes the lower shaft portion 6 to deflect downward around the universal joint mechanism 8, thereby forming a push-by guidance.

Embodiment 3

Figure 3:
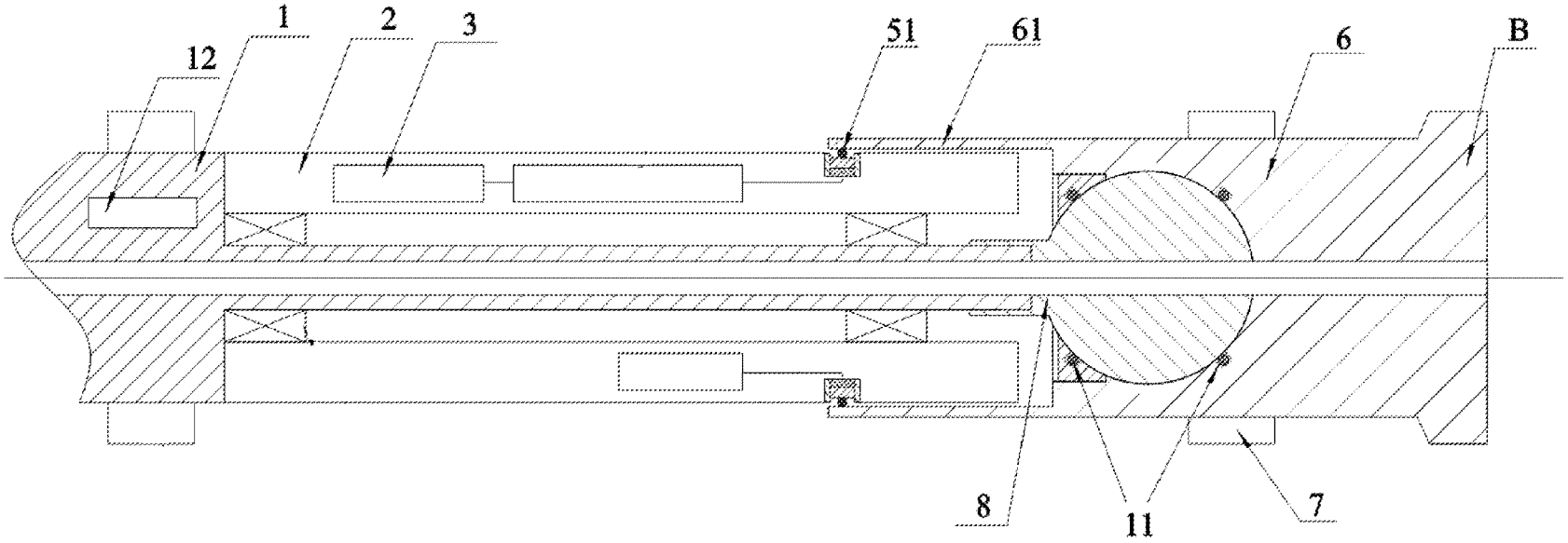
FIG. 3 is a rotary guiding device according to the third embodiment of the invention.

As shown in FIG. 3, the rotary guiding device in this embodiment is generally similar to the guide device in Embodiment 1, what's the main different is that the universal joint mechanism 8 as the steerable portion in this embodiment is a separate member. The universal joint mechanism 8 is axially connectable with the upper shaft portion 1 and the lower shaft portion 6, for example, by means of a key connection, the rotary transmission is realized. At the same time, the lower shaft portion 6 is deflectable relative to the universal joint mechanism 8, and a seal 11 is disposed between the universal joint mechanism 8 and the lower shaft portion 6.

The upper shaft portion 1 is provided with a circuit cavity 12, that is, a primary circuit cavity, at a position close to the non-rotating body 2. The non-rotating body 2 is provided with a circuit cavity 3 (i.e., a secondary circuit cavity) at a position close to an end of the upper shaft portion. Power transmission and data communication can be realized between the primary circuit cavity 12 and the secondary circuit cavity 3. During operation, due to the relative motion between the non-rotating body 2 and the upper shaft portion 1, the electric power in the primary circuit cavity 12 cannot be directly supplied to the secondary circuit cavity 3 in the non-rotating body 2. In the present application, a transport device (not shown in the figure) is mounted between the upper shaft portion 1 and the non-rotating body 2. The transmission device may be a contact type multi-core conductive slip ring, or may be a primary side and a secondary side of non-contact power and signal transmission, power and data communication between the primary circuit compartment 12 and the to secondary circuit compartment 3 is achieved by using of electromagnetic induction principles.

On the other hand, the hydraulic driving mechanism includes a hydraulic cylinder disposed along a radial direction of the non-rotating body and a piston disposed in the hydraulic cylinder, a push ball 51 is disposed between the piston and the rib portion 61, the piston pushes against the rib portion by the push ball 51.

The various embodiments in the specification are described in a progressive manner, and the same or similar parts between the various embodiments can be referred to each other, and each embodiment focuses on differences from the other embodiments. Particularlly, for the system embodiment, since it is basically similar to the method embodiment, the description is relatively simple, and the relevant parts can be referred to the description of the method embodiment.

The above description is only the embodiment of the present application and is not intended to limit the application. Various changes and modifications can be made to the present application by those skilled in the art. Any modifications, equivalents, improvements, etc. made within the spirit and scope of the present application are intended to be included within the scope to of the claims.

The invention claimed is:

1. A rotary guiding device based on radial driving force, comprising:

a rotating shaft to drive a tool head to rotate, the rotating shaft includes an upper shaft portion, a lower shaft portion, and a steerable portion, a separation distance exists between the upper shaft portion and the lower shaft portion in an axial direction, the upper shaft portion and the lower shaft portion are steerably connected by the steerable portion;

a non-rotating body mounted on the upper shaft portion, the non-rotating body is substantially non-rotating with respect to the rotating shaft in a circumferential direction when the rotating shaft rotationally drives the tool head, the lower shaft portion includes a rib portion that coincides at least partially in the axial direction with the non-rotating body, the non-rotating body includes at least three hydraulic driving mechanisms uniformly distributed along the circumferential direction, the at least three hydraulic driving mechanisms controllably generate radial drive forces, respectively, the radial driving forces act on the rib portion overlapping the non-rotating body so that the lower shaft portion is deflectable relative to the steerable portion, wherein a centralizer is disposed on the lower shaft portion, the centralizer arranged such that when the at least three hydraulic driving mechanisms generate the radial drive forces to act on the rib portion to deflect, the centralizer is to push against a well wall so that the lower shaft portion deflects relative to the steerable portion, a universal bearing is disposed between the non-rotating body and the upper shaft portion at a position that substantially coincides with a set position of the at least three hydraulic driving mechanisms in the axial direction, the steerable portion disposed on a side of the at least three hydraulic driving mechanisms and the centralizer that is away from the tool head, and a hydraulic driving mechanism among the at least three hydraulic driving mechanisms includes a hydraulic cylinder disposed along a radial direction of the non-rotating body and a piston disposed in the hydraulic cylinder.

2. The rotary guiding device of claim 1, wherein the steerable portion includes a cardan shaft or a flexible shaft.

3. The rotary guiding device of claim 1, wherein the at least three hydraulic driving mechanisms and the centralizer are respectively disposed on two sides of the steerable portion.

4. The rotary guiding device of claim 3, wherein the centralizer is detachably coupled to the lower shaft portion.

5. The rotary guiding device of claim 3, wherein the non-rotating body is provided with a circuit cavity, and the circuit cavity is connected to a hydraulic driving mechanism among the hydraulic driving mechanisms.

6. The rotary quidinq device of claim 1, wherein the centralizer is detachably coupled to the lower shaft portion.

7. The rotary guiding device of claim 1, wherein a push ball is disposed between the piston and the rib portion, the piston pushes against the rib portion by the push ball.

8. The rotary guiding device of claim 1, wherein the non-rotating body is provided with a circuit cavity, and the circuit cavity is connected to a hydraulic driving mechanism among the at least three hydraulic driving mechanisms.

* * * * *